United States Patent [19]

Tang et al.

[11] Patent Number: 4,644,305

[45] Date of Patent: Feb. 17, 1987

[54] ODD ORDER ELLIPTIC WAVEGUIDE CAVITY FILTERS

[75] Inventors: Wai-Cheung Tang, Kitchener; Joseph Frenna, Willowdale; David Siu, Hamilton, all of Canada

[73] Assignee: Com Dev. Ltd., Cambridge, Canada

[21] Appl. No.: 804,079

[22] Filed: Dec. 3, 1985

[30] Foreign Application Priority Data

Jun. 18, 1985 [CA] Canada ..... 484,402

[51] Int. Cl.[4] ..... H01P 1/207; H01P 1/208; H01P 7/06

[52] U.S. Cl. ..... 333/208; 333/209; 333/212; 333/230; 333/231

[58] Field of Search ..... 333/202, 208–212, 333/227–235, 219–223, 224–226, 239, 248

[56] References Cited

U.S. PATENT DOCUMENTS 2,890,421 6/1959 Currie ..... 333/209 X
4,410,865 10/1983 Young et al. ..... 333/208

*Primary Examiner*—Marvin L. Nussbaum
*Attorney, Agent, or Firm*—Daryl W. Schnurr

[57] ABSTRACT

An odd order bandpass filter has at least one cavity resonating at its resonant frequency in three independent orthogonal modes. The filter has at least one feedback coupling that is made to resonate and change sign at a center frequency. When the filter has two cavities, one being a triple cavity and the other being a dual mode cavity, the filter can be operated to achieve an elliptic function response. Also, the filter of the present invention can achieve a weight and volume reduction when compared to six-pole dual mode filters.

29 Claims, 13 Drawing Figures

ODD ORDER ELLIPTIC WAVEGUIDE CAVITY FILTERS

BACKGROUND OF THE INVENTION

1. Field of the Invention

This invention relates to odd order bandpass filters with at least one triple mode waveguide cavity. In particular, this invention relates to odd order bandpass filters having a triple mode cavity where there is at least one resonant feedback coupling created in the triple mode cavity. Further, this invention relates to an odd order bandpass filter where there are a plurality of cascade dual and triple mode waveguide cavities.

2. Description of the Prior Art

It is known to have odd order filters that produce an elliptic function response as set out in U.S. Pat. No. 4,246,555, naming Albert E. Williams as inventor and entitled "Odd Order Elliptic Function Narrow Bandpass Microwave Filters". Unfortunately, the filter described in said patent allows for only one single mode of propagation per cavity, thereby making the structure relatively large when compared to the present invention. It is also known to have dual mode cylindrical and/or cuboid filter structures that can be used to produce an elliptic function response as described by Atia, Williams and Newcomb in an article entitled "Narrow-Band Multiple-Coupled Cavity Synthesis", published in the Institute of Electrical and Electronics Engineers, Transactions on Circuits and Systems, Vol. CAS-21, No. 5, dated September, 1974, pp. 649 to 655. However, dual mode filters are also relatively large when compared to filters of the present invention. Further, more favourable results can be achieved with filters of the present invention than with prior filters.

Presently, it is common to use six-pole dual mode quasi-elliptic filters in continuous output multiplexers for satellite communications. Weight and volume savings are very important in satellite communications. Also, it has been found that five-pole odd order quasi-elliptic filter design can be used to provide better electrical performance than a six-pole dual mode filter. Further, when a five-pole filter design uses a triple and dual mode cavity, one cavity can be eliminated when compared to the six-pole dual mode design. This can result in a weight reduction of approximately 25% and a volume reduction of approximately 30%.

SUMMARY OF THE INVENTION

It is an object of the present invention to provide an odd order bandpass filter having an order equal to or greater than three where the number of transmission zeros that can be produced by the filter is one less than the order of the filter.

In accordance with the present invention, an odd order bandpass filter has at least one cavity having tuning screws and coupling screws arranged therein so that said cavity resonates at its resonant frequency in three independent orthogonal modes. The filter has at least one feedback coupling that is made to resonate and change sign at a centre frequency. The filter has an input and output for electro-magnetic energy and is of the order m+2, where m is an odd positive integer. Preferably, the filter has at least two waveguide cavities in cascade, with at least one cavity being a triple mode cavity and another adjacent cavity being a dual mode cavity.

In another embodiment of the invention, an odd order bandpass filter has at least one triple mode cavity and at least one dual mode cavity in cascade. The filter has an input and output for electro-magnetic energy with an iris containing an aperture to couple energy between adjacent cavities. The filter is of the order m+4, where m is an odd positive integer.

Preferably, the filter has at least one feedback coupling and, still more preferably, the feedback coupling is made to resonate and change a sign at a centre frequency.

DESCRIPTION OF A PREFERRED EMBODIMENT

Figure 1:
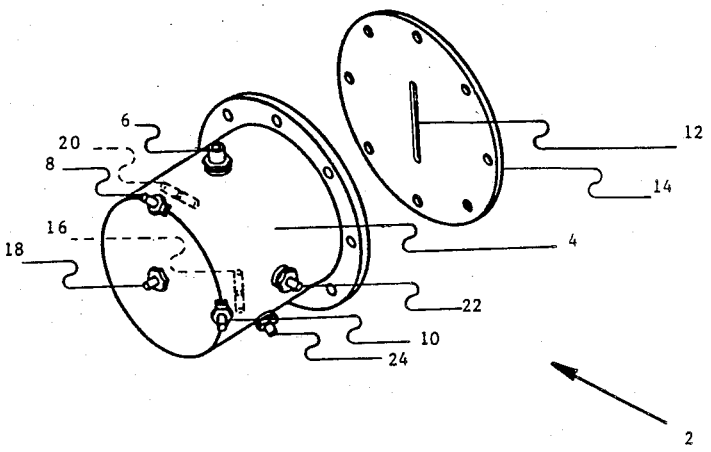
FIG. 1 is an exploded perspective view of an odd order bandpass filter with one cavity resonating in three independent orthogonal modes.

Referring to the drawings in greater detail, in FIG. 1 there is shown a three-pole elliptic filter 2 having one cavity 4 resonating in a first $TE_{111}$ mode, a second $TM_{010}$ mode and a third $TE_{111}$ mode. Electromagnetic energy is introduced into the cavity 4 through input coupling probe 6 which excites an electric field of the first $TE_{111}$ mode. Energy from the first $TE_{111}$ mode is coupled to the second $TM_{010}$ mode by coupling screw 8 which creates a physical perturbation to couple said energy. Energy is coupled for the second $TM_{010}$ mode to the third $TE_{111}$ mode by means of coupling screw 10. Energy is coupled out of the cavity 4 by means of a magnetic field transfer through aperture 12 located within iris disc 14. Tuning screws 16, 18 control the resonant frequencies of the first $TE_{111}$ mode and the second $TM_{010}$ mode respectively. The resonant frequency of the third $TE_{111}$ mode is controlled by two separate tuning screws 20, 22. Penetration of the tuning screws 16, 18, 20, 22 into the cavity 12 perturb an electric field of each orthogonal mode independently. In turn, this increases the cutoff wavelength in a plane of each tuning screw, thereby increasing the electrical length of the cavity 12 and decreasing the resonant frequency for a particular mode. Coupling screw 8 is at a 45° angle to tuning screws 16, 18. Coupling screw 10 is at a 45° angle to tuning screws 18, 22.

Coupling screw 24 creates a feedback coupling between the first and third modes (i.e. $M_{13}$). Coupling screw 24 is at a 45° angle to tuning screws 16, 22.

Figure 2:
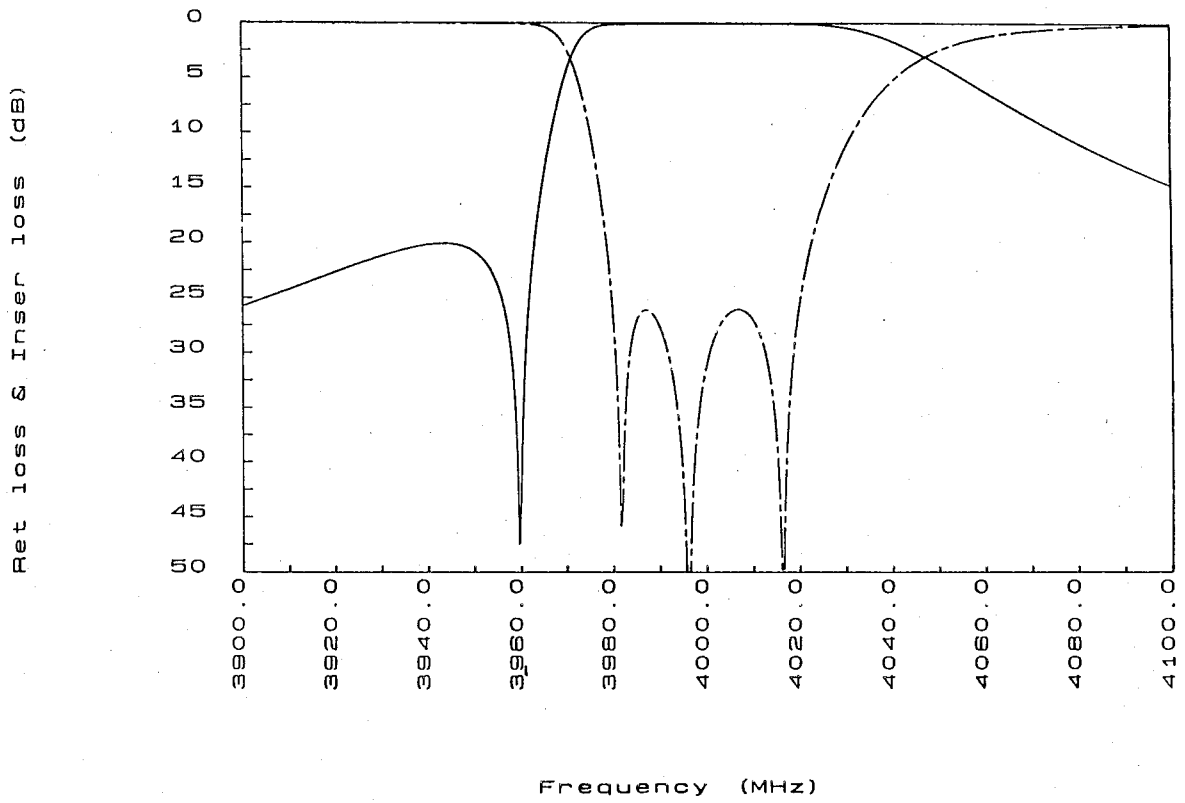
FIG. 2 is a graph of the return loss and insertion loss of the filter of FIG. 1 when $M_{13}$ is negative.
Figure 3:
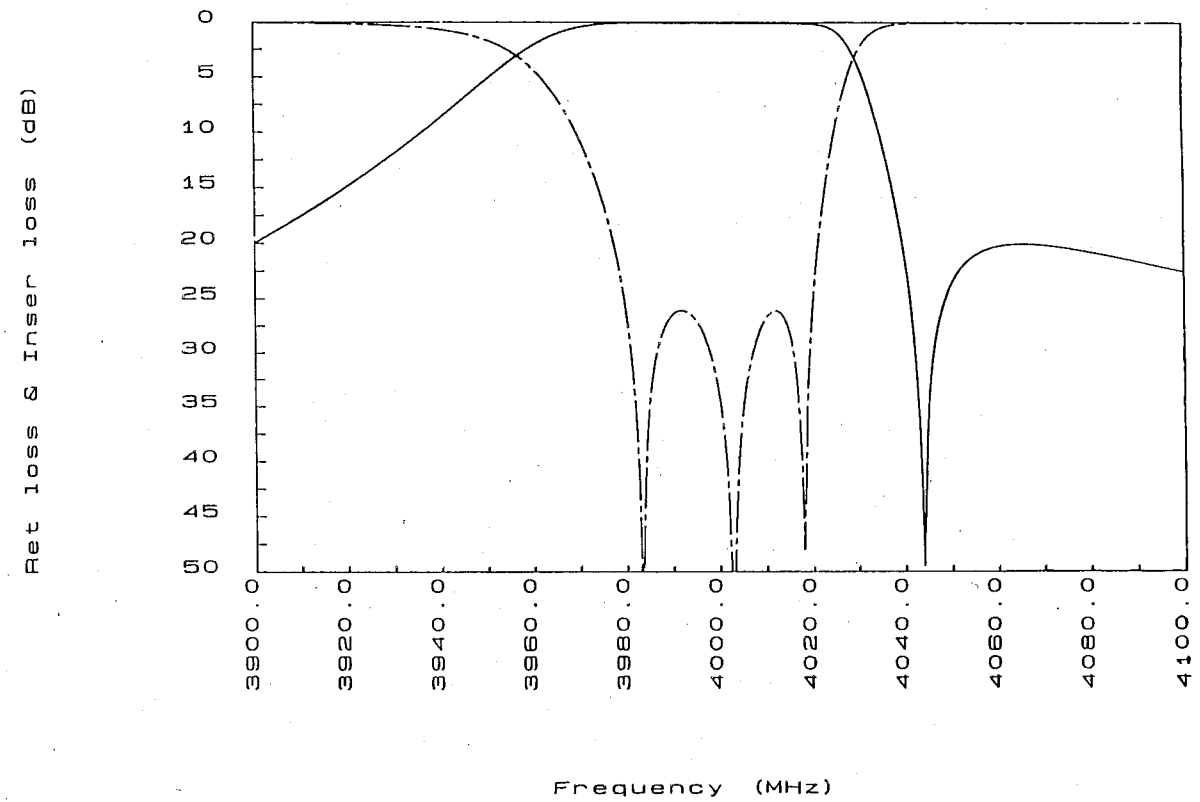
FIG. 3 is a graph of the return loss and insertion loss of the filter of FIG. 1 when $M_{13}$ is positive.
Figure 4:
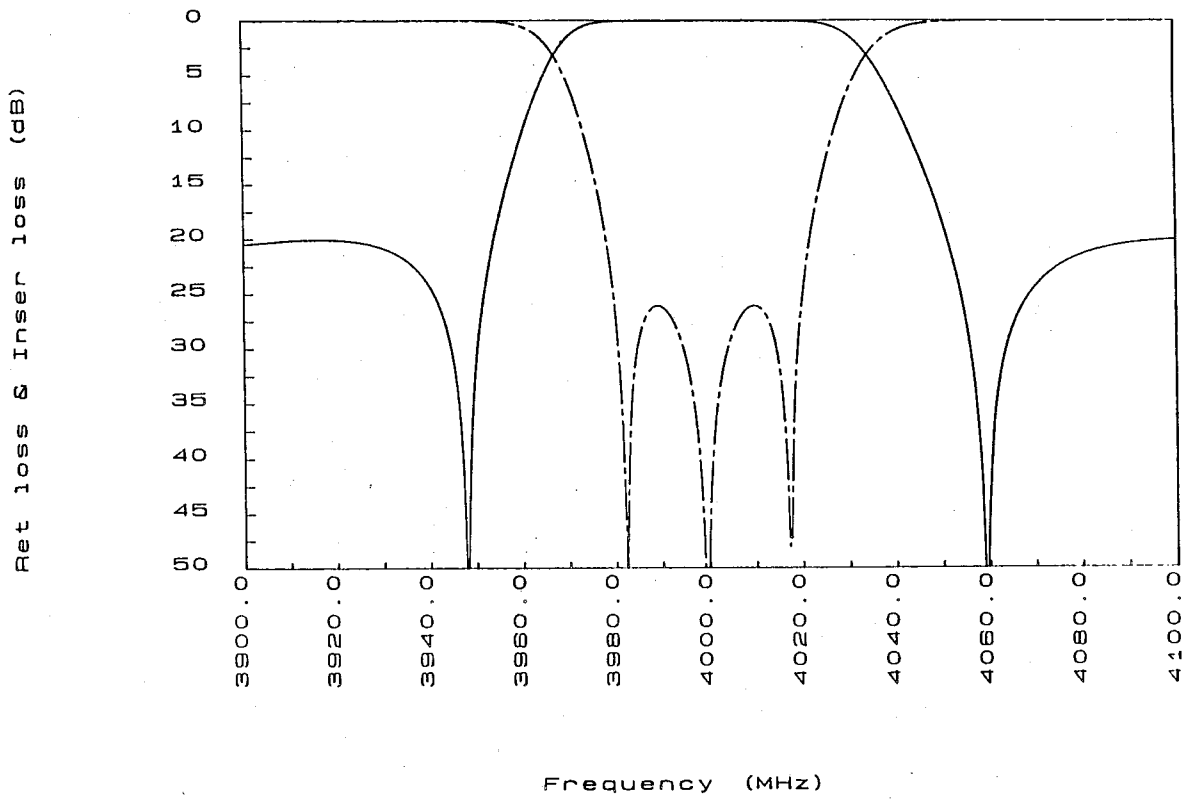
FIG. 4 is a graph of the isolation and return loss response of the filter of FIG. 1 when $M_{13}$ is made to resonate and change sign at a centre frequency.

If the sum of the feedback coupling subscript numbers is even, then the feedback coupling is an odd mode coupling and that coupling will create a single transmission zero. If the sum of the feedback coupling subscript numbers is odd then the feedback coupling is an even mode coupling and it will create a pair of transmission zeros. Since $M_{13}$ is an odd mode coupling, it would normally create a single transmission zero. Excluding tuning screw 20, the configuration of tuning and coupling screws shown in FIG. 1 creates a negative $M_{13}$ feedback coupling. If coupling screw 24 were repositioned so that it was at a 45° angle between tuning screws 16, 20, the feedback $M_{13}$ would be positive. If $M_{13}$ is negative, the transmission zero in the filter response is located below the centre frequency of the filter as shown in FIG. 2. If $M_{13}$ is positive, the transmission zero in the filter response is above the centre frequency as shown in FIG. 3. However, if $M_{13}$ can be made to resonate, then $M_{13}$ changes sign at the centre frequency and a symmetric three-pole elliptic filter can be created. A resonant feedback coupling can be created for $M_{13}$ of the filter 2 by introducing the extra tuning screw 20 and balancing the penetration of the tuning screws 20, 22 so as to create a resonant screw structure. The isolation and return loss responses of the filter 2, when the feedback coupling $M_{13}$ is made to resonate, are shown in FIG. 4. It can be seen that the introduction of the resonant screw structure by balancing the penetration of tuning screws 20, 22 produces odd order elliptic and quasi-elliptic function responses. Further, it can readily be seen from FIG. 4 that the three-pole filter 2 has a filter response with two transmission zeros, one less than the order of the filter.

Figure 5:
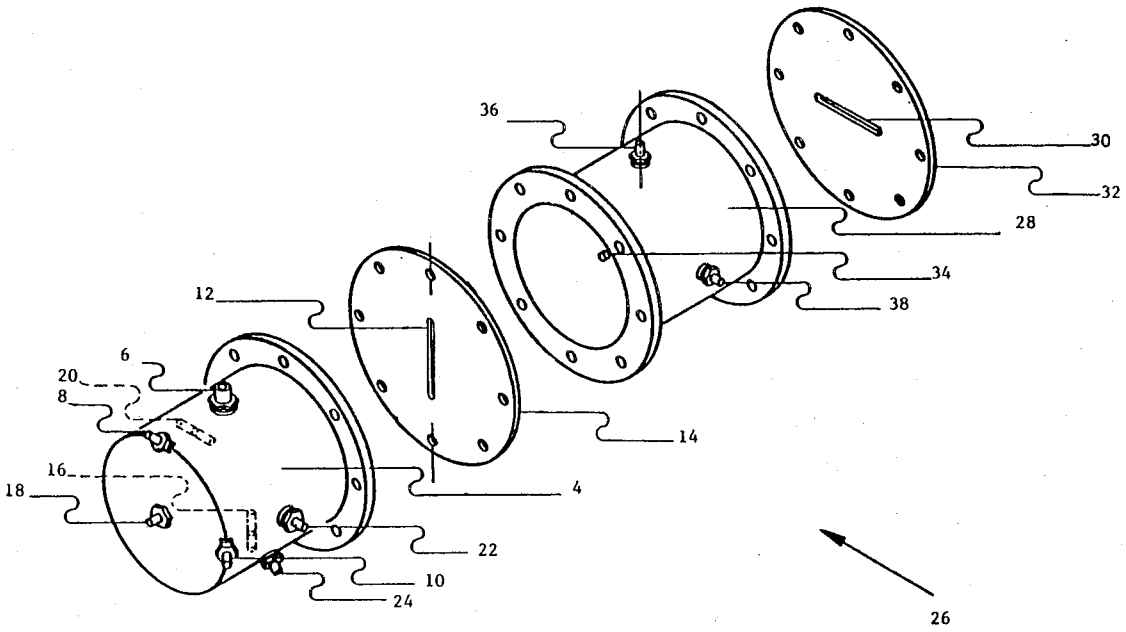
FIG. 5 is an exploded perspective view of an odd order filter having one triple mode cavity and one dual mode cavity separated by an iris having an aperture with a single slot.

In FIG. 5, there is shown a five-pole filter 26 having a triple mode cavity and a dual mode cavity in cascade. Since the triple mode cavity of FIG. 5 is virtually identical to the triple mode cavity of FIG. 1, the same reference numerals are used in FIG. 5 for those components of the filter 26 that are identical to those of filter 2 of FIG. 1. The filter 26 has a cascaded triple mode cavity 4 and a dual mode cavity 28. Input coupling probe 6 couples electro-magnetic energy into the cavity 4 to excite a first $TE_{111}$ mode and second $TM_{010}$ mode and a third $TE_{111}$ mode. The tuning screws and coupling screws of the cavity 4 operate similar to the three-pole filter 2 of FIG. 1. Energy is coupled out of the filter 26 through an aperture 30 located in an iris 32 on the cavity 28. The cavity 28 resonates in two independent $TE_{111}$ modes. Between the adjacent cavities 4, 28 of the filter 26, there is located an aperture 12 on an iris 14 to allow inter-cavity coupling between the third $TE_{111}$ mode of the cavity 4 and the fourth $TE_{111}$ mode of the cavity 28. In cavity 28, coupling screw 34 is located at a 45° angle to tuning screws 36, 38, thereby coupling energy from the fourth $TE_{111}$ mode to the fifth $TE_{111}$ mode. Energy is coupled out of the fifth $TE_{111}$ mode through a magnetic field transfer through aperture 30 on iris 32. The aperture 30 and iris 32 provide an output from the filter 26.

Figure 6:
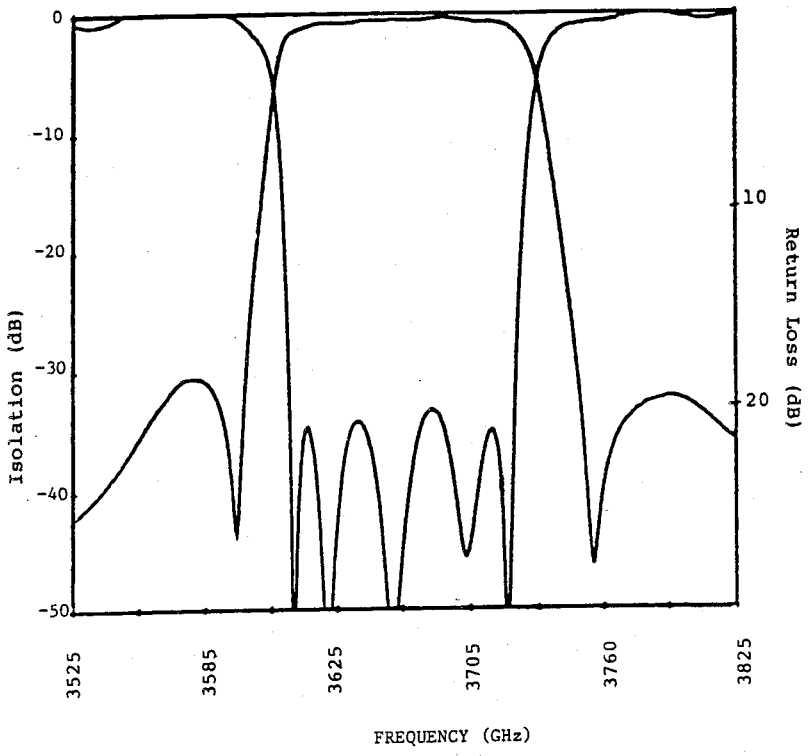
FIG. 6 is a graph showing the return loss and isolation responses that can be obtained using the filter shown in FIG. 5 when $M_{13}$ is resonant.
Figure 7:
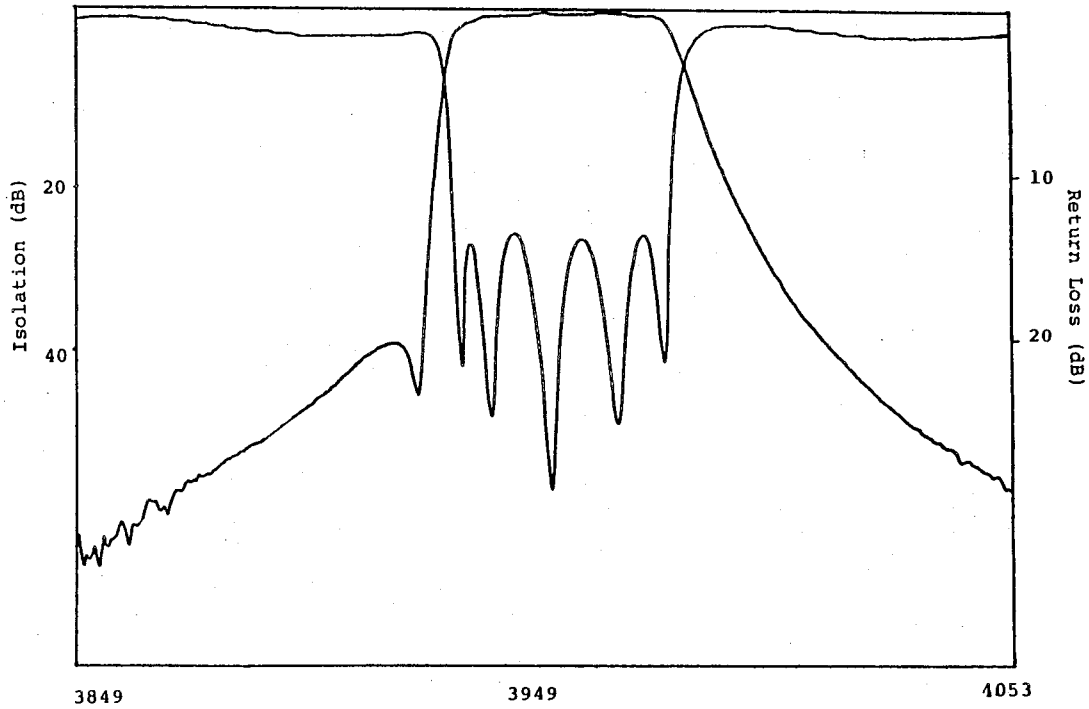
FIG. 7 is a graph of the return loss and isolation responses that can be obtained using the filter shown in FIG. 5 when $M_{13}$ is negative.

Since the cavity 4 of the five-pole filter 26 functions in a similar manner to the cavity 4 of the three-pole filter 2, the filter 26 has one resonant feedback coupling, $M_{13}$, between the first $TE_{111}$ mode and the third $TE_{111}$ mode. As can be seen from FIG. 6, the isolation and return loss responses of the filter 26 produce a symmetric five-pole quasi-elliptic filter response with two transmission zeros. If $M_{13}$ of the filter 26 was not caused to resonate by balancing the penetration of the tuning screws 20, 22, and, if $M_{13}$ were negative, then the isolation and return loss responses for the filter 26 would show only one transmission zero below the resonant frequency of the filter as set out in FIG. 7.

As stated above in relation to the filter 2, if the coupling screw 24 was repositioned so that it was at a 45° angle between the tuning screws 16, 20, the feedback coupling $M_{13}$ would be positive. This would produce an electrical response for the filter 26 with a single transmission zero above the resonant frequency of the filter. This response is not shown in the drawings.

Figure 8:
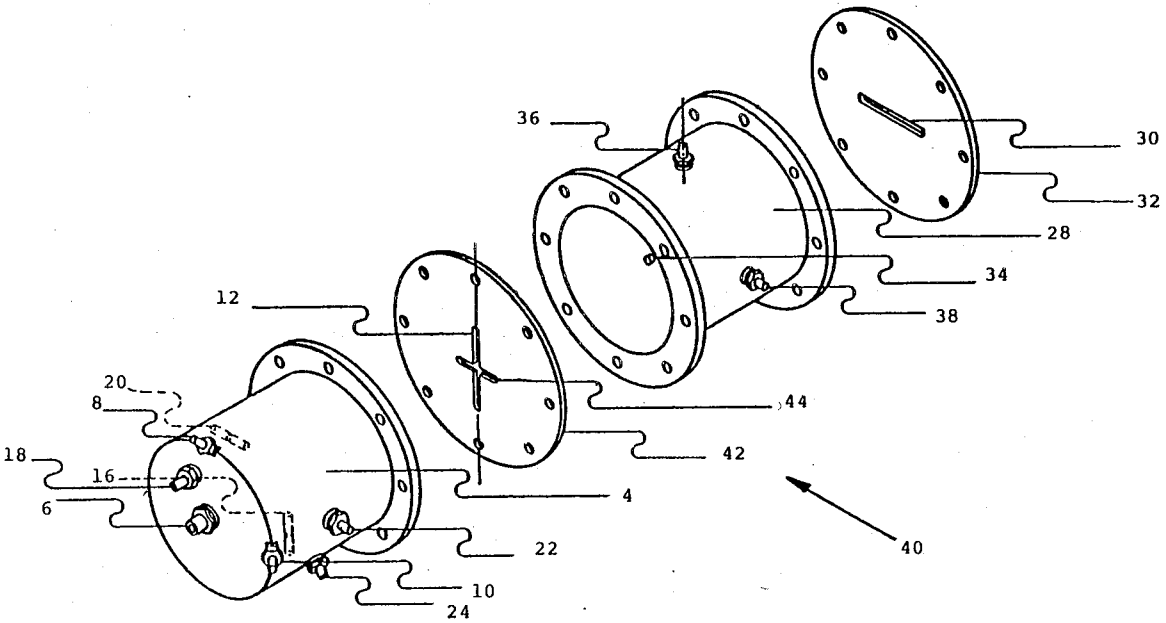
FIG. 8 is an exploded perspective view of a five-pole filter having one triple mode cavity and one dual mode cavity separated by an iris having a cruciform aperture.

In FIG. 8 there is shown a five-pole filter 40 which is very similar to the five-pole filter 26 shown in FIG. 5. Those components of the filter 40 that are essentially the same as components of the filter 26 will be designated by the same reference numeral. The filter 40 has a triple mode cavity 4 mounted in cascade with a dual mode cavity 28. The main physical difference between the filter 40 and the filter 26 is the new location of the input coupling probe 6 and the tuning screw 18. Also, between the cavities 4, 28 of the filter 40, there is located an iris 42 having an aperture 44 with a cruciform shape. The shape of the aperture 44 is different from the single slot aperture 12 of the filter 26.

In operation, the triple mode cavity 4 of the filter 40 resonates in a first $TM_{010}$ mode, a second $TE_{111}$ mode and a third $TE_{111}$ mode. The dual mode cavity 28 resonates in a fourth $TE_{111}$ mode and a fifth $TE_{111}$ mode. Tuning screws 18, 16, 22, 38 and 36 control the resonant frequencies of the first, second, third, fourth and fifth modes respectively. Input energy is coupled into the first $TM_{010}$ mode in cavity 4 through probe 6. Energy is coupled from the first $TM_{010}$ mode to the second $TE_{111}$ mode through coupling screw 8. Energy is coupled from the second $TE_{111}$ mode to the third $TE_{111}$ mode through the coupling screw 24. Coupling screw 8 is at a 45° angle to tuning screws 16, 18. Coupling screw 24 is at a 45° angle to tuning screws 16, 22. Energy is coupled from the third $TE_{111}$ mode in cavity 4 to the fourth $TE_{111}$ mode in cavity 28 through a magnetic field transfer from aperture 44 of the iris 42. Coupling screw 34 of the cavity 28 is at a 45° angle between tuning screws 36, 38 and couples energy from the fourth to the fifth $TE_{111}$ modes. Energy is coupled out of the cavity by means of magnetic field transfer through aperture 30 of iris 32.

The filter 40 has only one feedback coupling and it is not a resonant feedback coupling. The feedback coupling is $M_{25}$ as the second and fifth modes couple through the aperture 44 of the iris 42. $M_{25}$ is an even mode coupling as the sum of the subscript numbers is odd. Therefore, the feedback coupling $M_{25}$ creates a pair of transmission zeros and the return loss and isolation responses of the filter 40 are identical to those shown in FIG. 6 for the filter 26. There is no resonant feedback coupling in the filter 40 when it is operated in the manner described.

The tuning screws 16, 36 control the resonant frequencies of the second and fifth modes respectively. A feedback coupling results between the second and fifth modes as the tuning screws 16, 36 have the same orientation. The filter 40 is a quasi-elliptic filter having one pair of transmission zeros. The coupling screw 10 and the tuning screw 20 do not have any function in the filter 40 and could have been omitted from FIG. 8. The screws 10, 20 are shown in FIG. 8 even though they have no function to show that the filters 26, 40 can be used to produce different results with small physical changes.

Figure 9:
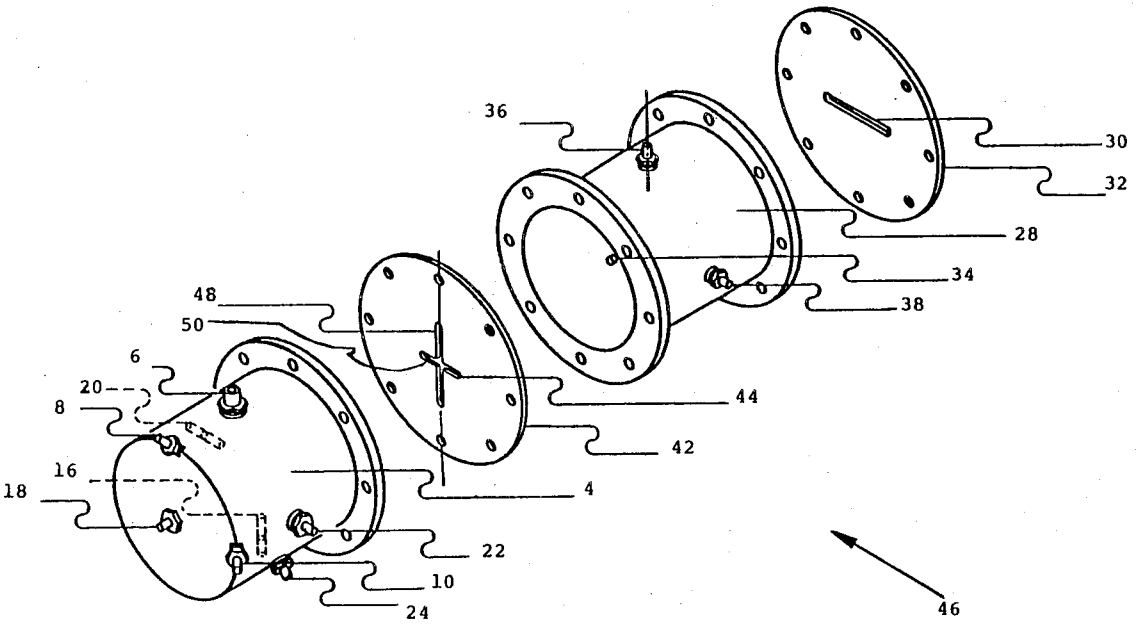
FIG. 9 is an exploded perspective view of a five-pole filter having a triple mode cavity and dual mode cavity separated by an iris containing an aperture with a cruciform shape, with an input moved to a different location from that shown in the filter for FIG. 8.

In FIG. 9, there is shown a filter 46 which is very similar to both filter 40 shown in FIG. 8 and filter 26 shown in FIG. 5. Similar components of the filter 46 to those of the filter 40 have been designated by the same reference number. The main physical difference between the filter 46 and the filter 40 is the relocation of the input coupling probe 6 and the tuning screw 18, as shown. The main physical difference between the filter 46 and the filter 26 is the shape of the aperture 44 in the iris 42. The aperture 44 of the filter 46 has a cruciform shape and the aperture 12 of the filter 26 is a single slot.

Figure 10:
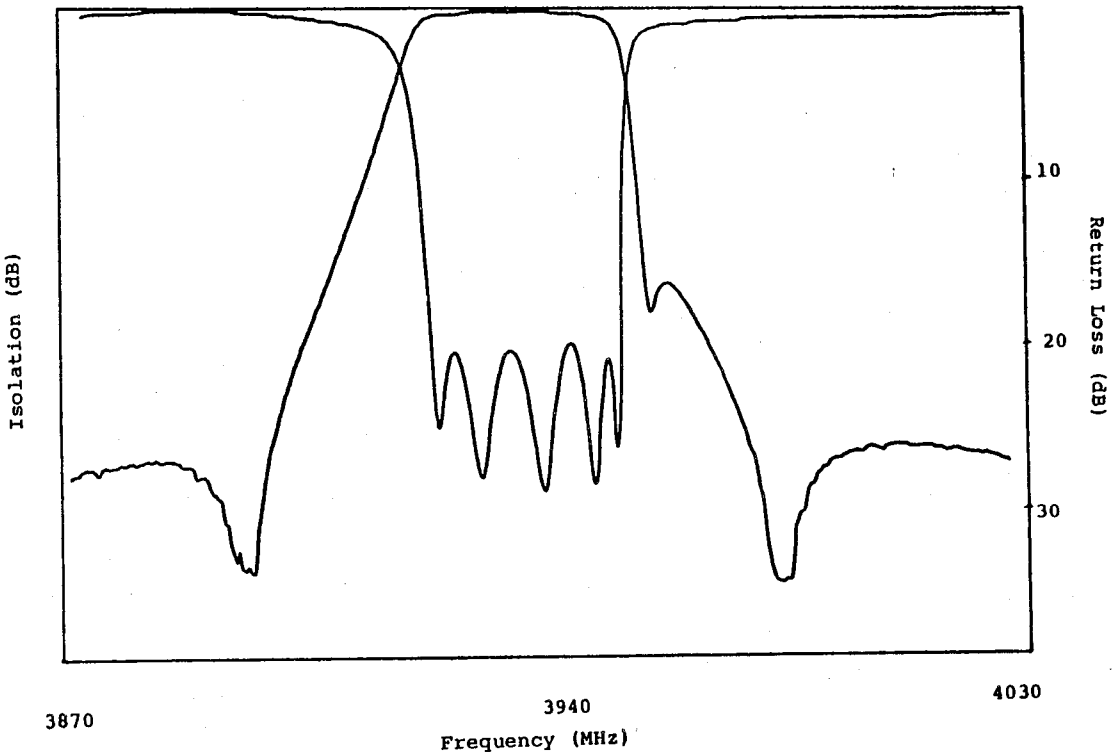
FIG. 10 is a graph of the return loss and isolation responses of the filter shown in FIG. 9 when said filter is operated so that there is only one resonant feedback coupling.

In operation, the filter 46, as shown in FIG. 9, has a triple mode cavity 4 that resonates in a first $TE_{111}$ mode, a second $TM_{010}$ mode and a third $TE_{111}$ mode. The dual mode cavity 28 resonates in fourth and fifth $TE_{111}$ modes. Tuning screws 16, 18 control the resonant frequencies of the first $TE_{111}$ mode and the second $TM_{010}$ mode respectively. Tuning screws 20, 22 together control the resonant frequency of the third $TE_{111}$ mode. Tuning screws 38, 36 control the resonant frequencies of the fourth $TE_{111}$ mode and the fifth $TE_{111}$ mode respectively. Energy is coupled into the first $TE_{111}$ mode in the cavity 4 through the input coupling probe 6. Energy is coupled from the first $TE_{111}$ mode to the second $TM_{010}$ mode through coupling screw 8. Energy is coupled from the second $TM_{010}$ mode to the third $TE_{111}$ mode through the coupling screw 10. Energy is coupled from the third $TE_{111}$ mode to the fourth $TE_{111}$ mode through a vertical slot 48 of the aperture 44. Energy is coupled from the fourth $TE_{111}$ mode to the fifth $TE_{111}$ mode through coupling screw 34. Energy is coupled out of the cavity 28 by means of magnetic field transfer through aperture 30 of iris 32. By balancing the penetration of the tuning screws 20, 22, a resonant feedback coupling is created between the first $TE_{111}$ mode and the third $TE_{111}$ mode (i.e. $M_{13}$) through coupling screw 24. A second feedback coupling occurs between the first $TE_{111}$ mode and the fifth $TE_{111}$ mode (i.e. $M_{15}$) through the horizontal slot 50 of the aperture 44. In the filter 46, the tuning screw 16, which controls the first $TE_{111}$ mode and the tuning screw 36 which controls the fifth $TE_{111}$ mode have the same orientation. Therefore, the first $TE_{111}$ mode is in the same orientation as the fifth $TE_{111}$ mode and a feedback coupling can be made to occur between these two modes. The resonant feedback coupling $M_{13}$ and the feedback coupling $M_{15}$ of the filter 46 produce an asymmetric five-pole filter with three transmission zeros. The measured isolation and return loss responses of the filter 46 operated in the manner described immediately above as shown in FIG. 10.

Figure 11:
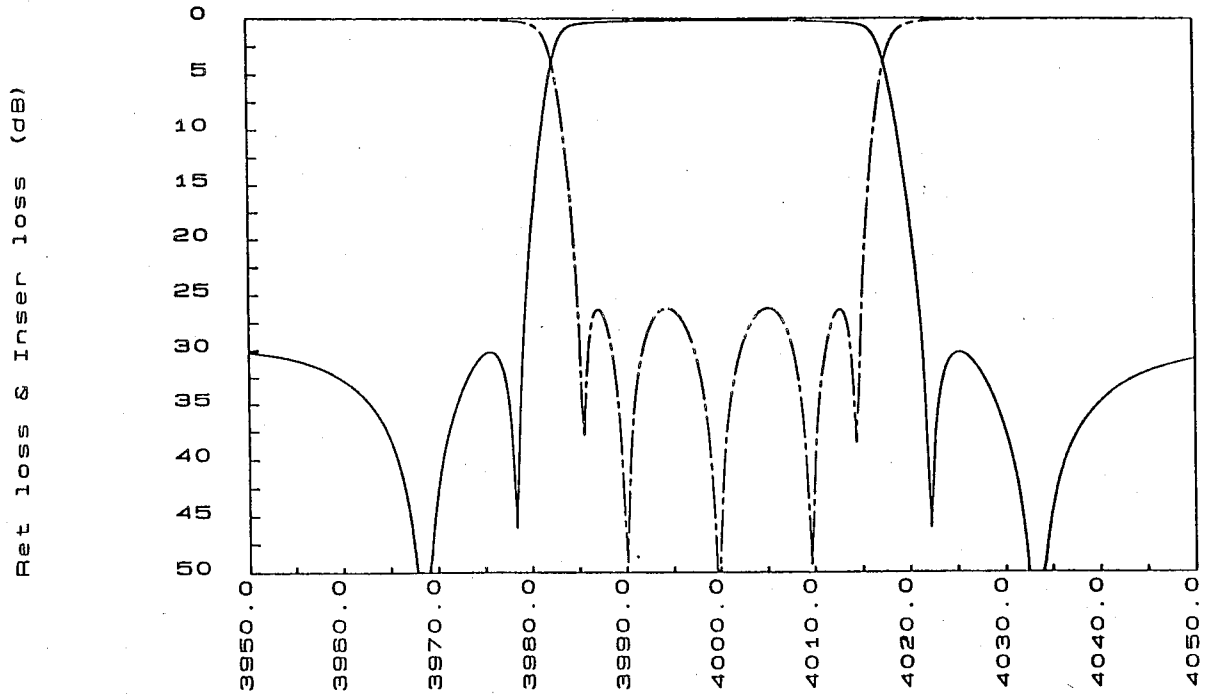
FIG. 11 is a graph of the return loss and isolation responses of the filter shown in FIG. 9 when said filter is operated to produce two resonant feedback couplings.

By making the horizontal slot of the aperture 44 of the filter 46 slightly longer so that it resonates at the resonant frequency of the filter 46, the feedback coupling, $M_{15}$, can be made to resonate and change sign at the resonant frequency. When the filter 46 is operated in this manner, the filter 46 will have two resonant feedback couplings. The first resonant feedback coupling is $M_{13}$ and the second resonant feedback coupling is $M_{15}$. The five-pole elliptic filter 46 will produce four transmission zeros, one less than the order of the filter, as shown in FIG. 11.

Figure 12:
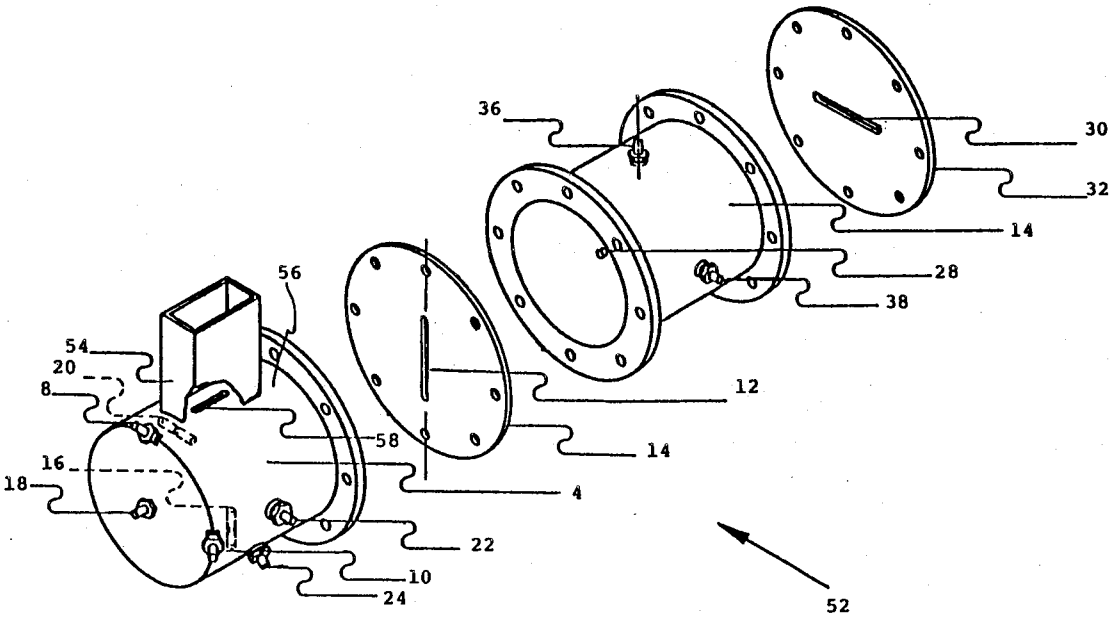
FIG. 12 is an exploded view of a filter similar to that shown in FIG. 5 where an input coupling is achieved by means of magnetic field transfer through an aperture in a wall of the triple mode cavity.

In FIG. 12, there is shown a filter 52 which is virtually identical to the filter 26 shown in FIG. 5, except for the input. Components of the filter 52 that are similar to components of the filter 26 are referred to by the same reference numeral. The filter 52 has an input 54 mounted on a wall 56 of the cavity 4. An aperture 58 is located in the wall 56 and input coupling is achieved by means of magnetic field transfer to a first $TE_{111}$ mode through said aperture 58.

Figure 13:
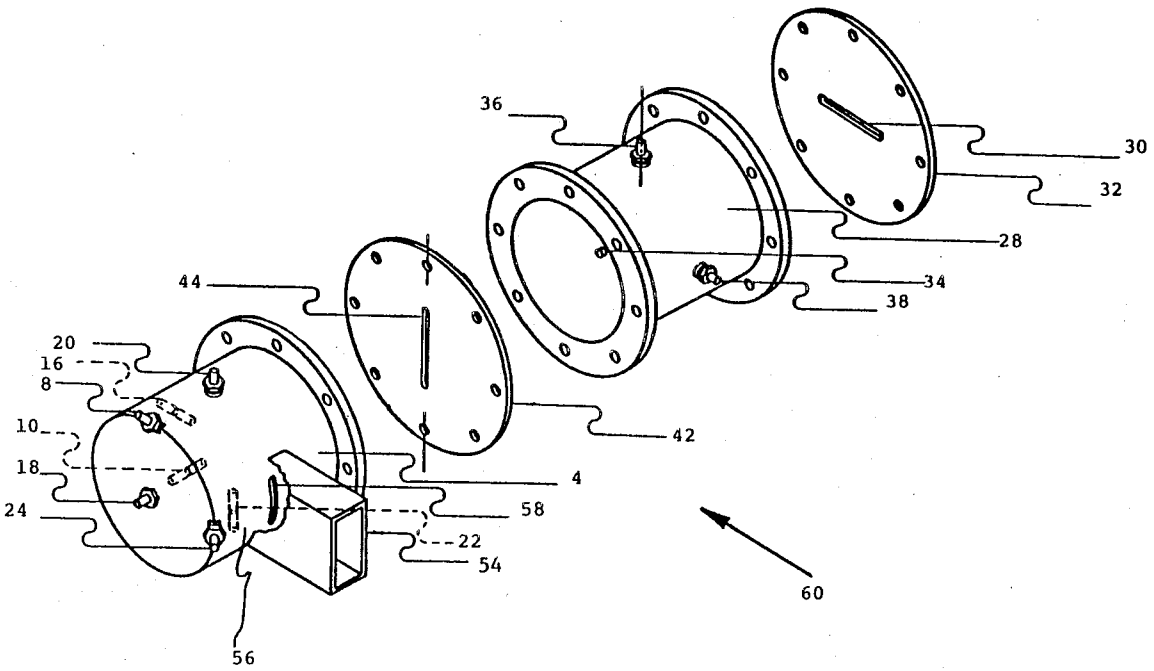
FIG. 13 is an exploded perspective view of a filter similar to that shown in FIG. 8 where an input coupling is achieved by means of magnetic field transfer through an aperture in a wall of the triple mode cavity.

In FIG. 13, there is shown a filter 60 that is similar to and can be operated in the same manner as the filter 40 of FIG. 8 but has an input that is similar to the input of the filter 52 of FIG. 12. Components of the filter 60 that are similar to the filter 40 are designated by the same reference numeral. Components of the input of the filter 60 that are similar to the input of the filter 52 are designated by the same reference numeral. Input 54 of the filter 60 is mounted on a wall 56 of the cavity 4. The wall 56 contains an aperture 58 and input coupling is achieved by means of magnetic field transfer through the aperture 58.

While the drawings show various embodiments of the invention using filters having one or two cavities, the invention is not limited to filters having a maximum of two cavities but will apply to any odd order filter containing any reasonable number of cavities within the scope of the attached claims. Also, in the discussions of the drawings, the five-pole filters are often described as having a triple mode cavity that resonates in two $TE_{111}$ modes and one $TM_{010}$ mode and a dual mode cavity resonating in two $TE_{111}$ modes. Where the filters of the present invention have dual mode cavities with a circular cross-section, they can operate in two $TE_{11(n+1)}$ modes, where n is a positive integer. Where the filters of the present invention are dual mode and have a square cross-section, they can operate in two $TE_{10(n+1)}$ modes, where n is a positive integer. Where the cavities of filters in accordance with the present invention are triple mode and have a circular cross-section, they can operate in two $TE_{11(n+1)}$ modes and one $TM_{01n}$ mode, where n is a positive integer. Alternatively, where the filters of the present invention have triple mode cavities with a square cross-section, they can operate in two $TE_{10(n+1)}$ modes and one $TM_{11n}$ mode, where n is a positive integer.

Where a filter has cavities with a square cross-section, the triple mode cavities can be operated in two $TE_{101}$ modes and one $TM_{110}$ mode and the dual mode cavities can operate in two $TE_{101}$ modes.

It can readily be seen from the present invention that it is possible to construct and operate an odd order filter to obtain elliptic or quasi-elliptic functions having one less transmission zero than the order of the filter. Specifically, a three-pole filter can obtain two transmission zeros and a five-pole filter can obtain four transmission zeros. The present invention can also be used to produce an odd order filter that can be operated in different ways to produce a different number of transmission zeros. For example, a five-pole filter can be operated to produce either two, three or four transmission zeros, as desired.

By cascading dual mode and triple mode cavities, odd order elliptic and quasi-elliptic filter functions can be realized, while achieving a volume and weight reduction without performance degradation.

What we claim as our invention is:

1. An odd order bandpass filter comprising at least one cavity, said cavity having tuning screws and coupling screws arranged therein so that it resonates at its resonant frequency in three independent orthogonal modes, said filter having at least one feedback coupling that is made to resonate and changes sign at a centre frequency, said filter having an input and output for electromagnetic energy, said filter being of the order m+2, where m is an odd positive integer.

2. A filter as claimed in claim 1 wherein there are at least two waveguide cavities in cascade, with at least one cavity being a triple mode cavity and another adjacent cavity being a dual mode cavity.

3. A filter as claimed in any one of claims 1 or 2 wherein the feedback coupling is made to resonate by properly positioning an extra tuning screw.

4. A filter as claimed in claim 2 wherein there is an iris located between the adjacent triple mode and dual mode cavities, said iris having a suitable aperture therein so that resonant feedback coupling will occur through said aperture.

5. A filter as claimed in claim 4 wherein the aperture has a cruciform shape and couples energy between cavities by means of magnetic field transfer.

6. A filter as claimed in claim 5 wherein the cavities have a circular cross-section and the triple mode cavity operates in two $TE_{11(n+1)}$ and one $TM_{01n}$ modes and the dual mode cavity operates in two $TE_{11(n+1)}$ modes, where n is a positive integer.

7. A filter as claimed in claim 4 wherein the cavities have a square cross-section and the triple mode cavity operates in two $TE_{10(n+1)}$ and one $TM_{11n}$ modes and the dual mode cavity operates in two $TE_{10(n+1)}$ modes, where n is a positive integer.

8. A filter as claimed in any one of claims 5 or 6 where n equals 0.

9. A filter as claimed in claim 1 wherein the triple mode cavity resonates in a first $TE_{111}$ mode, a second $TM_{010}$ mode and a third $TE_{111}$ mode and the resonant feedback coupling occurs between the first and third modes, said filter being capable of producing two transmission zeros.

10. A filter as claimed in claim 2 wherein the triple mode cavity resonates in a first $TE_{111}$ mode, a second $TM_{010}$ mode and a third $TE_{111}$ mode and the dual mode cavity resonates in a fourth $TE_{111}$ mode and a fifth $TE_{111}$ mode, with the resonant feedback coupling occurring between the first and third modes of the triple mode cavity.

11. A filter as claimed in claim 10 wherein there is an iris located between the adjacent triple mode cavities, said iris having a suitable aperture therein so that a second resonant feedback coupling will occur through said aperture between the first and fifth modes, said filter being capable of producing four transmission zeros.

12. A filter as claimed in claim 11 wherein the aperture has a cruciform shape and the resonant feedback coupling between the first and third modes is caused by the proper positioning of an extra tuning screw.

13. A filter as claimed in claim 1 wherein a resonant feedback coupling is created by the introduction of resonant screw structures to produce odd order elliptic and quasi-elliptic function filters.

14. A filter as claimed in claim 2 wherein a resonant feedback coupling is created by the introduction of a resonant aperture in an iris located between adjacent cavities, said aperture being used to produce an odd order elliptic and quasi-elliptic function response.

15. A filter as claimed in claim 14 wherein a second resonant feedback coupling is created by the introduction of resonant screw structures.

16. A filter as claimed in any one of claims 1 or 2 wherein the input coupling is through a coaxial probe that is used to couple energy into a $TE_{11(n+1)}$ mode, where n is a positive integer.

17. A filter as claimed in any one of claims 1 or 2 wherein input coupling is through an aperture in a triple mode cavity coupling energy into a $TE_{11(n+1)}$ mode, where n is a positive integer.

18. A filter as claimed in any one of claims 1 or 2 wherein an input coupling is through a coaxial probe coupling energy into the $TM_{01n}$ mode, where n is a positive integer.

19. A filter as claimed in any one of claims 1 or 2 wherein an input coupling is through an aperture in a triple mode cavity coupling energy into the $TM_{01n}$ mode, where n is a positive integer.

20. An odd order bandpass filter having at least one triple mode cavity and at least one dual mode cavity in cascade, said filter having an input and output for electromagnetic energy, with an iris containing an aperture to couple energy between adjacent cavities, said filter being of the order m+4, where m is an odd positive integer.

21. A filter as claimed in claim 20 wherein there is at least one feedback coupling.

22. A filter as claimed in claim 21 wherein the feedback coupling is made to resonate and changes sign at a centre frequency.

23. A filter as claimed in claim 22 wherein a resonant feedback coupling is created by the introduction of resonant screw structures to produce odd order elliptic and quasi-elliptic function response.

24. A filter as claimed in claim 22 wherein the resonant feedback coupling is created by the introduction of an iris having a resonant aperture that is used to produce odd order elliptic and quasi-elliptic function filters.

25. A filter as claimed in claim 23 wherein there are at least two resonant feedback couplings and the number of transmission zeros produced by the filter is one less than the order of the filter.

26. A filter as claimed in any one of claims 20, 21 or 22 wherein the cavities have a cylindrical cross-section and each triple mode cavity operates in two $TE_{11(n+1)}$ modes and one $TM_{01n}$ mode and each dual mode cavity operates in two $TE_{11(n+1)}$ modes, where n is a positive integer.

27. A filter as claimed in any one of claims 20, 21 or 22 wherein the cavities have a square cross-section and the triple mode cavities operate in two $TE_{10(n+1)}$ modes and one $TM_{11n}$ mode and the dual mode cavities operate in two $TE_{10(n+1)}$ modes, where n is a positive integer.

28. A filter as claimed in any one of claims 20, 21 or 22 wherein the cavities have a cylindrical cross-section and each triple mode cavity operates in two $TE_{111}$ modes and one $TM_{010}$ mode and each dual mode cavity operates in two $TE_{111}$ modes.

29. A filter as claimed in any one of claims 20, 21 or 22 wherein the cavities have a square cross-section and the triple mode cavities operate in two $TE_{101}$ modes and one $TM_{110}$ mode and the dual mode cavities operate in two $TE_{101}$ modes.

* * * * *